United States Patent [19]

Torti

[11] Patent Number: 4,768,237

[45] Date of Patent: Sep. 6, 1988

[54] TOILET PLUNGER

[76] Inventor: Emanuel Torti, 1135 Plainfield St., Johnston, R.I. 02919

[21] Appl. No.: 62,065

[22] Filed: Jun. 8, 1987

[51] Int. Cl.[4] ..... E03D 11/00

[52] U.S. Cl. ..... 4/256; 4/255

[58] Field of Search ..... 4/255-257

[56] References Cited

U.S. PATENT DOCUMENTS

| | | | |
|---|---|---|---|
| 1,734,206 | 11/1929 | Fisch | 4/255 |
| 1,972,114 | 9/1934 | Stephenson | 4/255 |
| 2,086,149 | 7/1937 | Allen | 4/256 |
| 2,233,378 | 2/1941 | Wilson | 4/256 |
| 2,579,671 | 12/1951 | Holl | 4/255 |
| 3,537,113 | 11/1970 | Elzner | 4/256 |
| 4,622,702 | 11/1986 | Allen | 4/255 |
| 4,674,137 | 6/1987 | Girse | 4/255 |

*Primary Examiner*—Henry J. Recla
*Assistant Examiner*—Linda J. Sholl
*Attorney, Agent, or Firm*—Salter & Michaelson

[57] ABSTRACT

A toilet plunger comprises a resiliently deformable plunger element, a tubular handle element which is connectable to a supply of pressurized water, a shutoff valve on the handle element, and a check valve element for preventing the inadvertent backflow of fluids through the handle element. The toilet plunger is operable for applying increased pressure to an obstruction in the outlet portion of a toilet or in a drain line by supplying pressurized water to the plunger element through the tubular handle element, and it is alternatively operable as a conventional toilet plunger by positioning the plunger element over the outlet portion of the toilet or drain line and reciprocably moving the handle element toward and away from the plunger element. The check valve element prevents the backflow of fluids through the handle element in the event that the shutoff valve is inadvertently left in an open position when the plunger is reciprocally operated as a conventional toilet plunger.

1 Claim, 1 Drawing Sheet

TOILET PLUNGER

BACKGROUND AND SUMMARY OF THE INVENTION

The instant invention relates to plumbing apparatus and more particularly to an improved toilet plunger for alleviating blockages in toilets and/or drain lines.

Conventional toilet plungers of the type comprising a plunger element and an elongated, rigid handle element are widely used for alleviating minor blockages in toilets and/or drain lines. Generally, the plunger element of a toilet plunger of this type is made of a resiliently deformable material in a substantially circular, rounded, open, cup-like configuration, and it is formed with an open interior area or cavity which opens outwardly through the open end of the plunger element. The handle element of a toilet plunger of this general type is generally made from a relatively rigid material, such as wood or plastic, and it is connected to the plunger element so that it extends from the end thereof which is opposite the open end. A toilet plunger of this general type is operable by first positioning the plunger element thereof so that it is in substantially sealed engagement with the outlet portion of a toilet bowl or with a fixture, such as a shower stall, around the drain therein. The handle element is then reciprocally moved toward and away from the plunger element so that the plunger element is alternately deformed and returned to an undeformed condition in order to alternately apply pressure and suction to the outlet portion of the toilet or the drain.

While toilet plungers of the above-described general type have been found to be generally effective for removing minor blockages in the outlet portions of toilets and/or drain lines, it has been found that they are often ineffective for removing many larger blockages, since they lack the ability to apply sufficient pressures thereto. In order to overcome this problem, a somewhat modified form of toilet plunger has been developed which is connectable to a supply of pressurized water in order to apply increased fluid pressures to blockages in toilets and/or drain lines. Specifically, a modified toilet plunger of this general type comprises a tubular handle element which has a shutoff valve therein and which is connectable to a supply of pressurized water for supplying water to the interior of the plunger element in order to apply increased pressures to blockages in toilets or in drain lines. Modified plungers and similar devices of this general type are disclosed in the U.S. Pat. Nos. 977,656 to La Rose; 1,804,874 to Hribar; and 1,941,065 to Williamson; and the Swiss patent No. 78,235 to König. Nevertheless, while the devices disclosed in these references represent the closest prior art to the subject invention of which the applicant is aware, they are believed to be of only general interest for reasons which will hereinafter be made apparent.

While modified toilet plungers of the above-described general type have, for the most part, been found to be effective, they have been found to have one major drawback. Specifically, it has been found that when modified plungers of the above described type are manually operated as conventional plungers, operators thereof often neglect to first close the shutoff valves in the handle elements thereof. Unfortunately, it has been found that when this occurs water and/or waste material often backs up through the handle elements of plungers and is discharged through the open upper ends thereof, often in the faces of the operators.

The instant invention provides an improved toilet plunger of the general type which is connectable to a supply of pressurized water, but which is adapted to prevent fluid backup in the handle element thereof. In particular, the plunger of the instant invention comprises a resiliently deformable, generally open cup-shaped plunger element having an open end and an open interior cavity and an elongated rigid handle element which extends from the plunger element at the end thereof opposite the open end thereof and is connectable to a supply of pressurized water. The handle element is of elongated tubular configuration, and it is attached to the plunger element so that it communicates with the open interior cavity for supplying pressurized water thereto. However, the toilet plunger further comprises means for preventng the backflow of fluids from the open interior cavity through the passage in the handle element. Specifically, the means for preventing the backflow of fluids preferably comprises a check valve element comprising a rubberized flap which is integrally formed in the plunger element so that it is resiliently movable to an open position wherein it is at least partially deflected into the open interior cavity of the plunger element. Further, the handle element is preferably secured to the plunger element so that the end thereof which is attached to the plunger element is positioned adjacent the rubberized flap; and accordingly, the flap is preferably movable between a closed position wherein it engages the adjacent end of the handle element to prevent the backflow of fluids into the handle element and an open position wherein the flap is deflected into the open interior cavity to permit fluids to pass from the handle element into the open interior cavity.

Accordingly, it is a primary object of the instant invention to provide an improved toilet plunger of the general type which is connectable to a supply of pressurized fluid for applying increased pressure to obstructions in drains and the like.

Another object of the instant invention is to provide a toilet plunger of the type which is connectable to a supply of pressurized fluid for applying increased pressures to obstructions in drains and the like wherein the backflow of fluids and/or waste material through the handle element portion of the plunger is prevented.

A still further object of the instant invention is to provide an improved toilet plunger of the type which is connectable to a supply of pressurized fluid, wherein a resilient check valve element is integrally formed in the interior of the plunger element portion thereof for preventing the backflow of fluids and/or waste material through the handle element.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
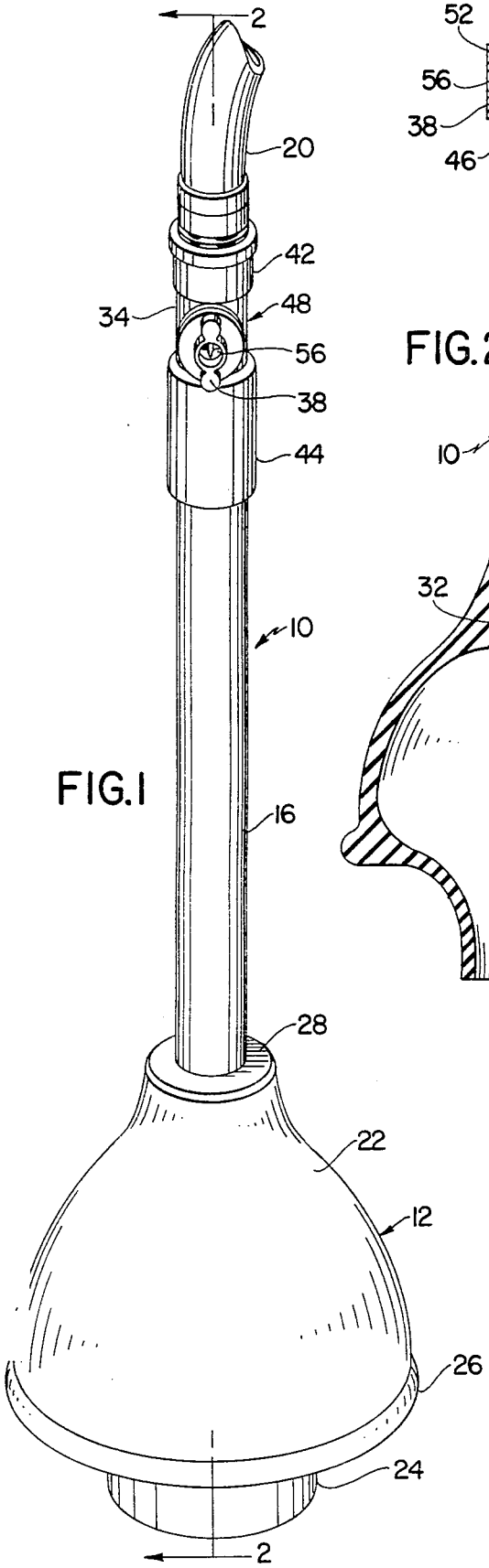
FIG. 1 is a perspective view of the plunger of the instant invention.
Figure 2:
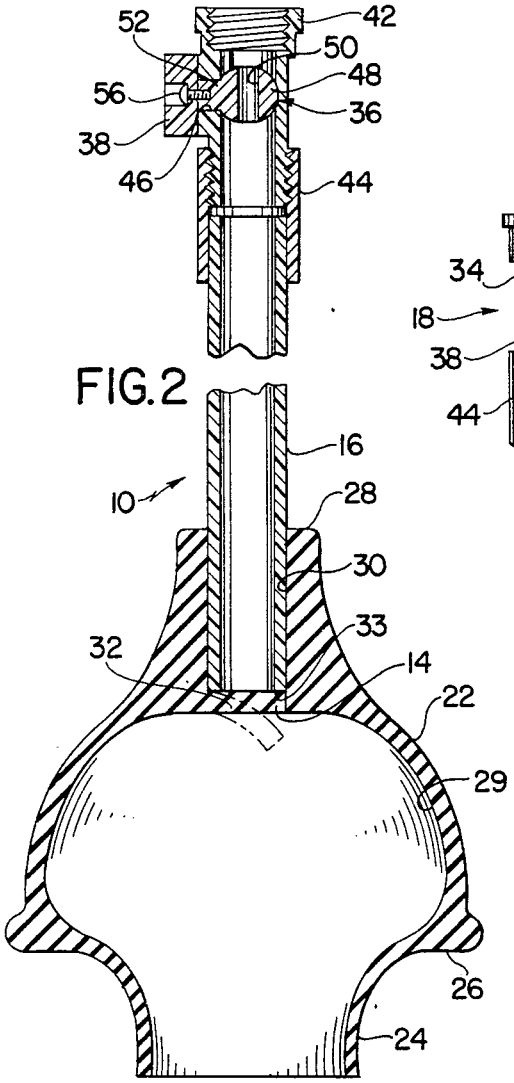
FIG. 2 is a side sectional view thereof.
Figure 4:
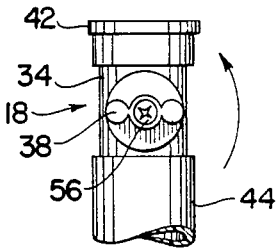
FIG. 4 is a similar view with the shutoff valve in a closed position.
Figure 5:
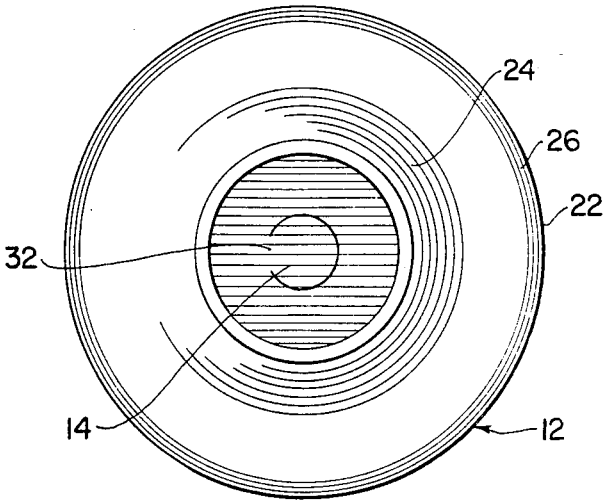
FIG. 5 is a bottom plan view of the plunger element portion of the plunger.

Referring now to the drawing, the toilet plunger of the instant invention is illustrated and generally indicated at 10 in FIGS. 1 and 2, and it comprises a plunger element generally indicated at 12, a check valve element 14, a tubular handle element 16, and a shutoff valve assembly generally indicated at 18. The plunger 10 is operable as a conventional toilet plunger for dislodging blockages in toilets and/or drain lines, and it is alternatively operable for applying increased pressures to obstructions in toilets or drain lines by connecting the handle element 16 to a water hose 20 so that pressurized water can be supplied to the plunger element 12 through the handle element 16. In this regard, when the plunger 10 is operated as a conventional toilet plunger, it is preferably disconnected from the hose 20, and the valve assembly 18 is preferably positioned in the closed position thereof illustrated in FIG. 4. However, in the event that an operator of the plunger 10 neglects to properly position the valve assembly 18 in the closed position thereof, the check valve element 14 is operative for preventing water and/or waste material from backing up in the handle element 16 and being discharged through the open value assembly 18 at the distal end of the handle element 16.

The plunger element 12 is preferably made of a deformable rubberized material, and it comprises a body portion 22 and a seal portion 24 which extends integrally from one end of the body portion 22. The body portion 22 is formed in a substantially circular, rounded, open, cup-shaped configuration so that it has an enlarged open end 26 and a reduced end 28. An enlarged open interior area or cavity 29 is formed in the body portion 22 so that it opens outwardly through the open end 26, and a tubular socket 30 extends inwardly in the body portion 22 from the reduced end 28, the socket 30 being dimensioned for snugly receiving the handle element 16 therein and terminating in closely spaced relation to the interior area 29. The enlarged end 26 of the body portion 22 merges with the seal portion 24 and it cooperates therewith to define an arcuately tapering tubular passage through which the open interior area or cavity 29 communicates with the exterior of the body portion 22. The seal portion 24 is preferably formed in a slightly reduced thickness to enable it to deform to the configuration of a toilet or drain and to provide an effective seal between the toilet or drain and the exterior of the body portion 22.

The check valve element 14 is integrally formed with the body portion 22 of the plunger element 12, and it is operative for obstructing the inner end of the socket 30 to prevent the backflow of fluids into the handle element 16. The check valve element 14 is preferably of substantially circular configuration, and it is integrally connected to the body portion 22 along a peripheral segment 32 of the check valve element 14. The check valve element 14 is perferably of substantially the same diameter as the socket 30, and it is preferably constructed and oriented so that it is normally disposed in a closed position wherein it is aligned with the socket 30 for obstructing the inner end thereof. The check valve element 14 is, however, resiliently deflectable to an open position wherein it extends into the open interior cavity 29 of the body portion 22 to provide communication between the socket 30 and the open cavity 29. The handle element 16 is assembled in the socket 30 so that it is positioned adjacent the check valve element 14, and hence the check valve element 14 is operative for obstructing the socket 30 so as to prevent the backflow of fluids through the handle element 16, although it is resiliently deflectable into the open interior cavity 29 to permit fluids to pass from the handle element 16 into the open interior cavity 29.

The handle element 16 comprises an elongated, rigid, tubular member which is preferably made of a durable plastic material, such as PVC, and it has an open inner end 33. The handle element 16 is dimensioned to be snugly received in the socket 30 so that the inner end 33 is positioned adjacent the check valve element 14 as illustrated in FIG. 2. In this regard, when the inner end 33 is positioned adjacent the check valve element 14 in this manner, the inner end 33 provides a seat for the check valve element 14 to make the check valve element 14 operative for more positively obstructing the adjacent end of the tubular handle element 16 to prevent the backflow of fluids therethrough from the open interior cavity 29.

Figure 3:
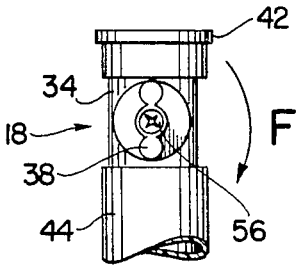
FIG. 3 is a side elevational view of the shutoff valve of the plunger in an open position.

The valve assembly 18 comprises a valve body 34, a valve member generally indicated at 36 which is mounted in the body 34, and a valve handle 38 which is connected to the valve member 36 for rotating it in the valve body 34. The valve body 34 is preferably made of a suitable rigid and durable plastic material, such as PVC, in a generally tubular configuration, and it has a threaded male end 40 and a threaded female end 42. The male end 40 of the valve body 34 is received in threaded engagement in a coupling piece 44 which is received on the handle element 16 and preferably secured thereto with a suitable adhesive. An aperture 46 is formed in the side wall of the valve body 34 for mounting the valve element 36 therein so that it is rotatable by means of the handle 38. The valve member 36 comprises a substantially spherical valve element 48 having a tubular passage 50 therethrough and a stem portion 52 which extends integrally from the valve element 48 in substantially perpendicular relation to the passage 50. The valve member 36 is preferably integrally formed from a durable, low-friction plastic material, such as nylon, and it is assembled in the valve body 34 so that the valve element 48 is rotatable in the tubular interior thereof and so that the stem portion 52 is rotatable in the aperture 46. In this connection, as illustrated, the valve member 38 is rotatable between the open position illustrated in FIGS. 1 and 3 wherein the passage 50 in the valve element 48 is substantially aligned with the tubular interior of the valve body 34 so that fluids can pass therethrough; and the closed position illustrated in FIG. 4, wherein the passage 50 is substantially perpendicular to the tubular interior of the body 34 and obstructed by the side walls of the body 34 so that fluids are prevented from passing through the body 34. The handle 38 is secured on the stem portion 52 with a screw 54 for manipulating the valve member 36 between the open and closed positions thereof, the handle 38 being aligned with the tubular passage 50 for providing a visual indication of the position of the valve element 48.

For use and operation of the plunger 10 for removing an obstruction in the outlet portion of a toilet, the plunger element 12 is placed in the toilet so that the seal portion 24 extends into the outlet portion of the toilet bowl and so that the end 26 of the body portion 22 is disposed in sealed engagement with the toilet bowl adjacent the outlet portion thereof. The plunger 10 is then operable in a manner similar to a conventional toilet plunger by positioning the valve assembly 18 in the closed position thereof and reciprocally moving the handle element 16 toward and away from the plunger element 12 so that the plunger element 12 is alternately deformed and returned to its undeformed disposition to alternately apply pressure and suction to the outlet portion of the toilet. However, in the event that an operator of the plunger 10 forgets to first position the valve assembly 18 in the closed position thereof before operating the plunger 10 in this manner, the check valve element 14 prevents the backflow of fluids and/or waste material into the handle element 16 so that the fluids and/or waste material are not discharged through the threaded female end 42. Further, the check valve element 14 enables a certain amount of pressure to be applied to the toilet even though the valve assembly 18 is in an open position. The device 10 is also operable in a similar manner for alleviating obstructions in drain lines and other fixtures, such as shower stalls or sinks. Alternatively, however, the device 10 is operable for applying increased fluid pressures to obstructions by connecting the valve assembly 18 to a supply of pressurized water by means of the hose 20. When the plunger 10 is operated in this manner, the shutoff valve assembly 18 is moved to the open position so that the pressurized water supply communicates with the open interior area 32 of the body portion 20 through the tubular interior of the handle element 16 and the check valve element 14. In this regard, when the plunger 10 is connected to a supply of pressurized water in this manner, the force of the water is normally sufficient to deflect the check valve element 14 into the open interior area 29 to enable the water to pass into the interior area 29. Accordingly, when the plunger 10 is positioned in sealed engagement with a toilet bowl around the outlet portion thereof, the pressure of the water supply is applied to the outlet portion of the toilet bowl so that increased pressure is applied to any obstructions therein or in drain lines connected thereto. The device 10 can also be operated in a similar manner for applying increased pressures to obstructions in the drain lines of other fixtures, such as shower stalls and sinks. Further, it is possible to operate the plunger 10 with a reciprocating motion while the valve assembly 16 is in the open position so that further agitation is produced as pressurized water is applied to the obstruction.

It is seen, therefore, that the instant invention provides a toilet plunger which is operative with substantially increased effectiveness. The plunger 10 is connectable to a supply of pressurized water for applying increased pressures to blockages in the outlet portions of toilets and/or drain lines. The plunger 10 is, however, also operative in a conventional manner for alternately applying pressure and suction to obstructions in the outlet portions of toilet bowls or in drain lines. Further, when the toilet plunger is operated in a conventional manner, the check valve element 14 effectively prevents the backflow of fluids and/or waste materials through the handle element 16 in the event that the valve assembly 18 is inadavertently left in an open position. Accordingly, it is seen that the plunger 10 is operative with substantially increased effectiveness and versatility, and that, as a result, the instant invention represents a significant advancement in the art which has substantial commerical merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a toilet plunger of the type comprising a rubberized, resiliently deformable, generally cup-shaped plunger element having an open end and an open interior cavity which opens outwardly at said open end, and an elongated rigid handle element which extends from said plunger element at the end thereof opposite said open end, said handle element having an elongated longitudinal passage therethrough and having an open inner end which is closely spaced from said interior cavity, means for connecting said handle element to a supply of pressurized fluid so that said fluid is supplied to said open interior cavity through said passage, the improvement comprising a rubberized flap integrally formed with said plunger element, said flap being normally received in covering engagement with said handle element inner end to prevent the backflow of fluid from said interior cavity through said passage in said handle element, said flap being resiliently deflectable into said open interior cavity to permit fluid to pass through said passage in said handle element into said open interior cavity.

* * * * *